US005892169A

United States Patent [19]

Shapiro

[11] Patent Number: 5,892,169

[45] Date of Patent: Apr. 6, 1999

[54] MUSIC DRUM MUTE DEVICE

[76] Inventor: Victor Shapiro, 1 Landmark Sq., Port Chester, N.Y. 10573

[21] Appl. No.: 964,105

[22] Filed: Nov. 6, 1997

[51] Int. Cl.[6] ..... G10D 13/02

[52] U.S. Cl. ..... 84/411 M; 84/411 P

[58] Field of Search ..... 84/411 M, 411 P, 84/413

[56] References Cited

U.S. PATENT DOCUMENTS

| | | | |
|---|---|---|---|
| 3,453,924 | 7/1969 | Glick . | |
| 4,102,235 | 7/1978 | Le Masters . | |
| 4,406,207 | 9/1983 | Criscone | 84/411 P |
| 4,581,973 | 4/1986 | Hoshino | 84/1.14 |
| 4,589,323 | 5/1986 | Belli et al. . | |
| 4,671,158 | 6/1987 | Saputo . | |
| 4,745,839 | 5/1988 | Peraino | 84/411 M |
| 5,031,499 | 7/1991 | Wang . | |
| 5,492,047 | 2/1996 | Oliveri . | |
| 5,587,543 | 12/1996 | Da Silva Marques | 84/411 M |

FOREIGN PATENT DOCUMENTS

| | | |
|---|---|---|
| 604233 | 4/1926 | France . |

*Primary Examiner*—William M. Shoop, Jr.
*Assistant Examiner*—Kim Lockett
*Attorney, Agent, or Firm*—Leo Zucker

[57] ABSTRACT

A mute device for use with music drums including tom-toms, snares, and the like. The device includes a drum stick strike plate, and at least one sound post projecting from the strike plate. The sound post contacts the drum skin at a location where the skin is supported on the drum shell housing, when the strike plate is mounted on the drum.

12 Claims, 1 Drawing Sheet

MUSIC DRUM MUTE DEVICE

BACKGROUND OF THE INVENTION

1. Field of the Invention

The present invention relates to mute devices for musical instruments, and particularly to a mute device for a drum.

2. Discussion of the Known Art

Musicians who must practice on their instruments at home, where the neighbors may not always care to listen, have to make certain compromises. For drummers, so-called drum practice pads are available. These pads are placed directly on the drum head or skin, and the drummer strikes the pad with his/her drum sticks instead of striking the drum skin directly.

It has been found that besides greatly reducing the amplitude or level of the natural drum sound,, the known pads distort the tonal quality of the drum and yield a relatively dull, "thud-like" sound when struck. Accordingly, there is a genuine need for a drum mute device that does not distort natural drum overtones and which decreases only the amplitude of such tones during at-home practice sessions.

U.S. Pat. No. 3,453,924 (Jul. 8, 1969) discloses a drum mute including a round drum pad surrounded by a rim, and a number of support feet radially inward of the rim. If used on a tom-tom drum, the drum mute of the '924 patent has been found to deaden the drum sound and to suppress natural drum overtones significantly.

A number of other drum mute devices in the form of pads that lay directly on top of an existing drum head are disclosed, for example., in U.S. Pat. No. 4,589,323 (May 20, 1986); U.S. Pat. No. 5,492,047 (Feb. 20, 1996); and U.S. Pat. No. 4,102,235 (Jul. 25, 1978). See also French Patent 604,233 (Apr. 30, 1926).

Thus, there remains a need for a light weight, relatively inexpensive drum mute device which when used with tom-tom and other drums including snares, substantially preserves the tonal qualities and characteristics of the unattenuated drum sound, i.e., a mute device that acts only to soften the intensity of a drum sound without distorting the drum's natural overtones. There is also a need for a drum mute device that allows the user to adjust the intensity of the muted drum sound within a certain range.

SUMMARY OF THE INVENTION

According to the invention, a mute device for a drum having a drum skin, and a drum shell housing for supporting the drum skin, includes a drum stick strike plate, and at least one sound post projecting from the strike plate. The sound post is positioned relative to the strike plate so that it contacts the drum skin at a location where the drum skin is supported on the drum shell housing, when the strike plate is mounted on the drum.

For a better understanding of the invention, reference is made to the following description taken in conjunction with the accompanying drawing, and the scope of the invention will be pointed out in the appended claims.

DETAILED DESCRIPTION OF THE INVENTION

Figure 1:
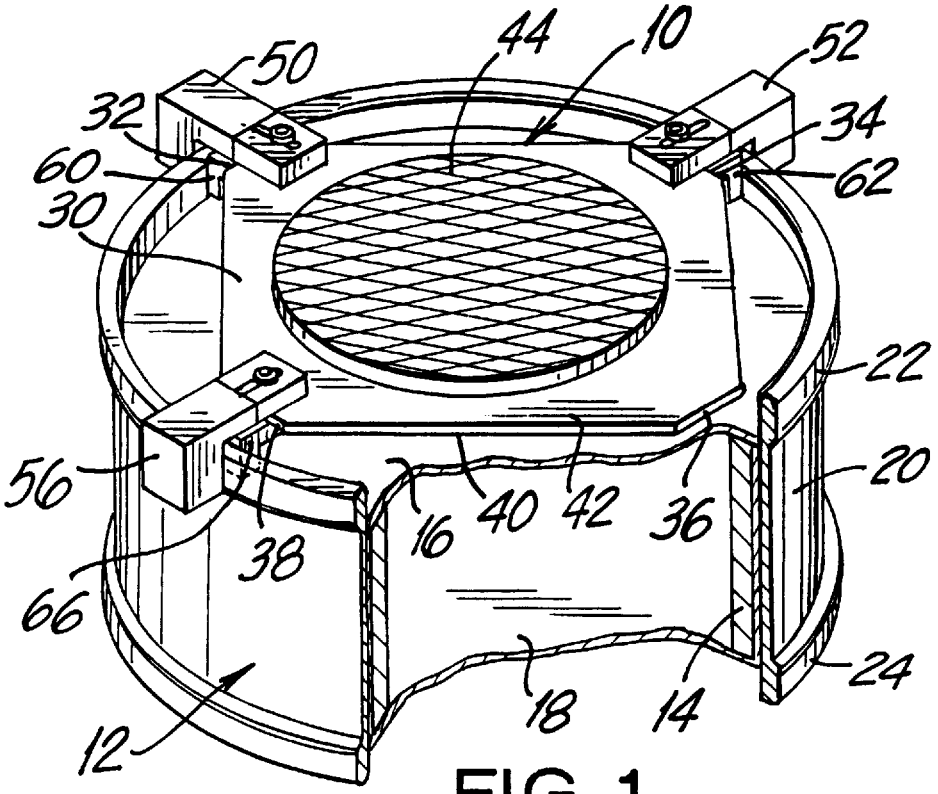
FIG.1 is a perspective view, partly in section, of a mute device according to the invention in place on a drum.

FIG. 1 shows a mute device 10 according to the invention. The mute device 10 is shown mounted on a drum 12. In the illustrated embodiment, drum 12 is, e.g., a tom-tom drum having a cylindrical shell housing 14. The drum 12 has a drum head or skin 16 that is stretched over the upper circumference of the shell housing 14 (see FIG. 2). A conventional drum skin tightening mechanism (not shown) may be incorporated on the drum 12 to allow a user to maintain a desired tension for the drum skin 16.

The drum 12 also has another drum skin 18 that is stretched over and supported by the lower circumference of the shell housing 14. The mute device 10 may, however, be applied to drums lacking a lower drum skin (e.g., a bongo drum).

An outer band 20 surrounds the outer periphery of the shell housing 14. An upstanding rim 22 projects from the upper circumference of the band 20. Another rim 24 projects downward from the bottom circumference of the band 20.

The drum mute device 10 includes a drum stick strike plate 30. Preferably, the plate 30 has an outer perimeter of such a size and shape as not to extend beyond the circumference of the drum rim 22, when the strike plate 30 is centered above the drum head 16. For example, as shown in FIG. 1, the strike plate 30 may have a generally octagonal perimeter with side corners 32, 34, 36 and 38 that approach the rim 22.

The strike plate 30 is preferably relatively light-weight and is formed from, for example, an acrylic plastics or polystyrene base plate 40 with an elastomeric layer 42 atop the base plate 40. The layer 42 may be formed of, e.g., a 3/32 inch thick blown foam plastics material, and the base plate 40 itself may be cut from a rigid sheet of, e.g., 1/8 inch thick polystyrene.

A round, elastomeric strike pad 44 is fixed atop the strike plate 30 over the elastomeric layer 42 on the plate. The strike pad 44 is made of, for example and without limitation, rubber foam, gum rubber, blown plastics, leather, vinyl, combinations of wood, vinyl and rubber layers; or a cork and rubber composite. The layer 42 has a thickness of typically about 1/4 inch.

The strike pad 44 is preferably detachably fastened on the strike plate 30 by use of fasteners, or the like (not shown). Allowing the strike pad 44 to be removable or exchangeable with other pads of different thicknesses or materials, enables the user to experience a desired "feel" when beating on the pad 44 with drum sticks during a practice session.

Preferably, a number of mounting clamps are fixed near the perimeter of the strike plate 30 to enable the mute device 10 to be securely mounted on the drum 12. Use of the clamps will allow a user to orient the drum 12 in any desired position without fear that the mute device 10 might fall away from the drum. Three clamps 50, 52 and 56 are viewable in FIG. 1, and each clamp is in the form of a generally "L"-shaped bracket. An upper leg of each clamp is fixed to the strike plate 30 by a threaded fastener (e.g., fastener 58 in FIG. 2). Each clamp fastener passes through an elongate slot in the upper clamp leg so as to permit the clamp to be set at a desired position in a radial direction of the drum 12 once the strike plate 30 is placed over the drum.

At least one sound post according to the invention is also fixed near the perimeter of the strike plate 30. Three sound posts 60, 62 and 66 are viewable in FIG. 1, and are described below in connection with FIG. 2.

Figure 2:
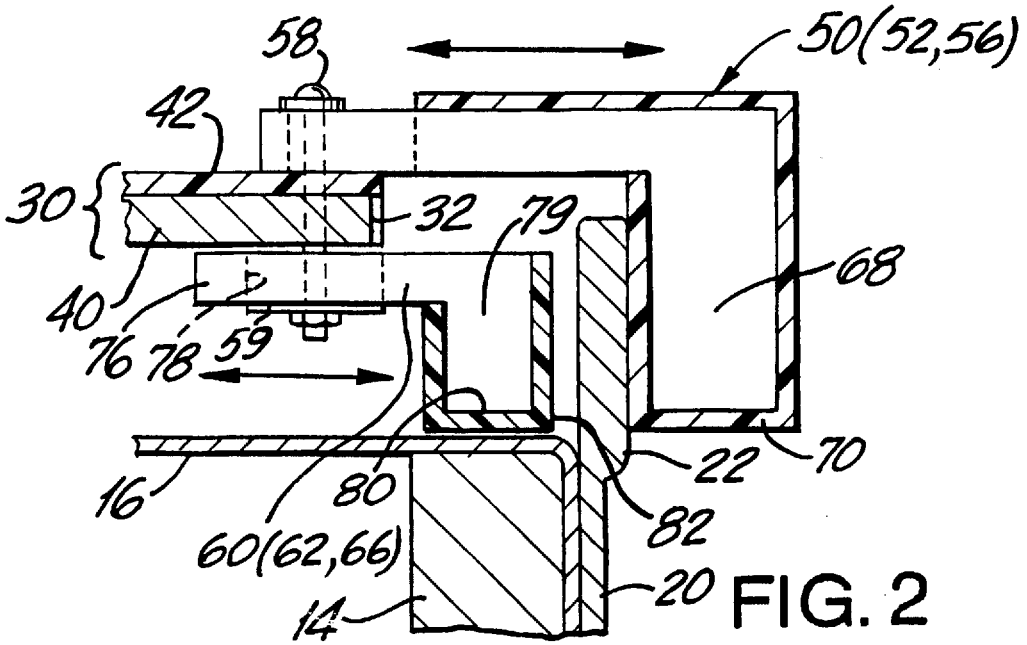
FIG. 2 is an enlarged view, partly in cross-section showing a sound post and a clamp of the mute device in FIG. 1.

FIG. 2 is an enlarged, partly cross-sectional view showing clamp 50 and sound post 60, with the strike plate 30 placed above and centered over the drum skin 16. A rim engaging part 68 of the clamp 50 is configured to confront the drum rim 22. Preferably, the rim engaging part 68 has, e.g., a vinyl rubber protective layer 70 to avoid scratching the drum rim 22 once the part 68 engages the rim frictionally and the clamp fastener 58 is tightened to fix the clamp on the strike plate 30. Preferably, with the strike plate 30 centered over and above the drum skin 16, each of the mounting clamps is positioned so that its rim engaging part will abut the drum rim 22, the clamps are tightened in place on the strike plate 30, and the device 10 is urged onto the rim 22.

The sound posts are each formed of a generally "L"-shaped piece of acrylic plastics or equivalent rigid material. As seen in FIG. 2, sound post 60 has an upper leg 76 with an elongate slot 78 through which the bottom half of the fastener 58 passes. Protrusions 59 next to the bottom of slot 78 serve to captivate a fastener nut.

The sound post 60 also has a contact leg 79 with a face 80 that contacts the drum skin 16 at a location where the skin 16 is supported on the upper circumference of the drum shell housing 14, when the strike plate 30 is mounted on the drum rim 22. The sound post face 80 preferably has a vinyl rubber protective layer 82. Thus, the sound post face 80 acts to transmit percussive forces or vibrations from the strike plate 30 to the drum shell housing 14 in direct contact with the drum skin 16, in response to beating of drum sticks on the strike pad 44.

Sound post 60 is adjustable in position in a radial direction in the region of the drum shell housing 14. Specifically, the long slot 78 in the upper leg 76 permits the post 60 to be fixed underneath the strike plate 30 at various positions in the region of the drum shell housing 14. If desired, sound post 60 may be constructed and arranged to be positioned or swung so that its contact face 80 makes contact with the drum skin 16 where the skin 16 has no underlying support from the drum shell housing 14. As mentioned, however, it has been discovered that natural overtones of the drum 12 are least distorted if the faces of the sound posts contact the drum skin 16 where the skin is also in contact with the drum shell housing 14.

It has also been discovered that varying the overall height of the sound post contact leg 79 will change the amplitude or level of the resultant drum sound. For example, in the illustrated embodiment, the height of the contact leg 79 from the bottom of the face layer 82 to the upper horizontal surface of the leg 76, is about 7/16 inch. Increasing this height has been found to decrease the amplitude of the drum sound when the mute device 10 is mounted on the drum 12. Care should always be taken to avoid having the lower horizontal surface of the leg 76 (or the bottom of fastener 58) come into contact with the drum skin 16.

Further, it has been found that tensioning of the strike plate 30 by creating a "tight" fit between the rim engaging part of each clamp and the drum rim 22, when the mute device 10 is mounted on the drum 12, serves to decrease vibrations induced in the strike plate 30 when struck by a drum stick and, thus, tends to decrease the amplitude of the drum sound.

While the foregoing description represents a preferred embodiment of the invention, it will be obvious to those skilled in the art that various changes and modifications may be made, without departing from the spirit and scope of the invention as pointed out by the following claims.

I claim:

1. A mute device for a drum having a drum skin, and a drum shell housing for supporting the drum skin, the mute device comprising:

a drum stick strike plate;

a clamp arrangement associated with the strike plate to mount the strike plate on a drum; and at least one sound post projecting from the strike plate and positioned relative to the strike plate to contact the drum skin at a location where the drum skin is supported on the drum shell housing, when the strike plate is mounted on the drum.

2. A drum mute device according to claim 1, the clamp arrangement including a number of clamps fastened to the drum stick strike plate, said clamps being configured to engage part of a drum on which the mute device is to be mounted.

3. A mute device according to claim 2, wherein said clamps are constructed and arranged to be adjustable so as to clamp the strike plate on the drum with a desired tension in the strike plate.

4. A drum mute device according to claim 1, wherein the strike plate includes a strike pad on a top surface of the plate.

5. A drum mute device according to claim 1, wherein the sound post has a contact face with a protective layer for contacting the drum skin.

6. A drum mute device according to claim 1, wherein the sound post is constructed and arranged to be adjustable in position in the region of the drum shell housing when the strike plate is mounted on the drum.

7. In combination;

a drum having a drum skin and a drum shell housing for supporting the drum skin; and a drum mute device mounted on the drum for softening the intensity of sounds produced by the drum, the mute device comprising, a drum stick strike plate;

a clamp arrangement associated with the strike plate to mount the strike plate on the drum; and at least one sound post projecting from the strike plate and positioned relative to the strike plate to contact the drum skin at a location where the drum skin is supported on the drum shell housing.

8. The combination of claim 7, wherein the clamp arrangement includes a number of clamps fastened to the drum stick strike plate, said clamps being configured to engage part of the drum on which the mute device is mounted.

9. A mute device according to claim 8, wherein said clamps are constructed and arranged to be adjustable so as to clamp the strike plate on the drum with a desired tension in the strike plate.

10. The combination of claim 7, wherein the strike plate includes a strike pad on a top surface of the plate.

11. The combination of claim 7, wherein the sound post has a contact face with a protective layer for contacting the drum skin.

12. The combination of claim 7, wherein the sound post is constructed and arranged to be adjustable in position in the region of the drum shell housing.

* * * * *